United States Patent [19]

Pepper et al.

[11] Patent Number: 5,044,298

[45] Date of Patent: Sep. 3, 1991

[54] MOVABLE BOAT CANOPY

[75] Inventors: Geoffrey T. Pepper; James R. Buttrey, both of Lebanon, Mo.; Donald P. Dimmitt, Chicago; William S. Becker, Park Forest, both of Ill.

[73] Assignee: Outboard Marine Corporation, Waukegan, Ill.

[21] Appl. No.: 413,328

[22] Filed: Sep. 27, 1989

[51] Int. Cl.[5] ..... B63B 17/02

[52] U.S. Cl. ..... 114/361; 135/88

[58] Field of Search ..... 114/343, 361; 135/88, 135/89, 101, 111, 901

[56] References Cited

U.S. PATENT DOCUMENTS

| | | | |
|---|---|---|---|
| 245,651 | 8/1881 | Meech | 114/361 |
| 1,705,592 | 3/1929 | Smith | 114/361 |
| 1,741,318 | 12/1929 | Kroh | 114/361 |
| 2,280,729 | 4/1942 | Sutton | 9/1 |
| 2,570,911 | 10/1951 | Birdlebough | 9/1 |
| 2,714,387 | 8/1955 | Meldrum | 114/361 |
| 2,817,345 | 12/1957 | Woodruff | 114/361 |
| 2,833,296 | 5/1958 | Woodruff | 114/361 |
| 2,947,277 | 8/1960 | Stevens | 114/361 |
| 3,165,762 | 1/1965 | Hage | 114/361 |
| 3,179,959 | 4/1965 | McDougall | 9/1 |
| 3,370,308 | 2/1968 | Krenzler | 9/1 |
| 3,797,436 | 3/1974 | Moore | 114/361 |
| 4,223,414 | 9/1980 | Dickson | 114/361 |
| 4,562,786 | 1/1986 | Pruonto | 114/61 |

FOREIGN PATENT DOCUMENTS 3534405 4/1987 Fed. Rep. of Germany .

*Primary Examiner*—Sherman Basinger
*Assistant Examiner*—Stephen P. Avila
*Attorney, Agent, or Firm*—Michael, Best & Friedrich

[57] ABSTRACT

A boat comprising a deck having thereon a helm, and a canopy operable in a first mode wherein the canopy is spaced a first distance above the deck and a second mode wherein the canopy is spaced a second distance less than the first distance above the deck and wherein the canopy permits an operator to be positioned at the helm.

18 Claims, 2 Drawing Sheets

MOVABLE BOAT CANOPY

BACKGROUND OF THE INVENTION

The invention relates to boats, and, more particularly, to boats such as Pontoon boats with vertically movable canopies, i.e., canopies that can be raised or lowered.

A known pontoon boat includes a canopy that is movable between a normal, raised position and a lowered position that facilitates storage of the boat. A disadvantage of this arrangement is that the boat operator cannot operate the boat when the canopy is in its lowered position.

SUMMARY OF THE INVENTION

The invention provides a boat comprising a deck having thereon a helm, and canopy means operable in a first mode wherein the canopy means is spaced a first distance above the deck and a second mode wherein the canopy means is spaced a second distance less than the first distance above the deck, wherein the canopy means is located above the helm, and wherein the canopy means permits an operator to be positioned at the helm.

The invention also provides a boat comprising a deck having thereon a helm and an operator's seat located adjacent the helm, a canopy including spaced-apart portions defining therebetween an opening, and a cover movable between a retracted position wherein the cover does not extend over the opening and an extended position wherein the cover extends over the opening and means for moving the canopy relative to the deck between a raised position wherein the canopy is spaced a first distance above the deck and a lowered position wherein the canopy is spaced a second distance less than the first distance above the deck and wherein the opening is located above the helm, whereby the head of an operator can extend through the opening when the cover is in the retracted position, so that the canopy permits an operator to be positioned at the helm, the moving means including generally parallel, spaced-apart support members which extend generally vertically when the canopy is in the raised position and each of which has a lower end pivotally connected to the deck and an upper end pivotally connected to the canopy, and the moving means also including means including a hydraulic cylinder-piston assembly having one end pivotally connected to the deck and an opposite end pivotally connected to one of the support members for pivotally moving the support members relative to the deck.

The invention also Provides a boat comprising a deck having thereon a helm, a canopy including spaced-apart portions defining therebetween an opening, and a cover movable between a retracted position wherein the cover does not extend over the opening and an extended position wherein the cover extends over the opening, and means for supporting the canopy above the deck.

A principal feature of the invention is the provision of a boat with a canopy that permits normal operation of the boat when the canopy is in its lowered position. This permits an operator to drive the boat beneath a bridge or other overhead obstacle.

Another principal feature of the invention is the provision of a boat with a canopy including an opening which is located above the boat helm when the canopy is in its lowered position and having a removable cover extending over the opening.

Other features and advantages of the invention will become apparent to those skilled in the art upon review of the following detailed description, claims and drawings.

Figure 1:
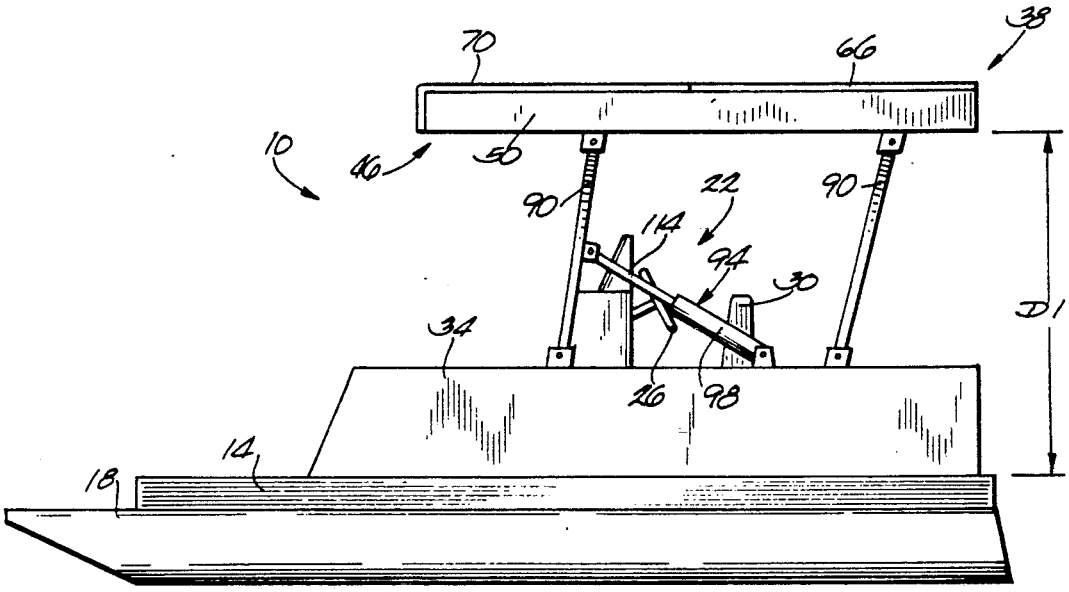
FIG. 1 is a side elevational view of a boat embodying the invention and including a canopy. The canopy is shown in its raised position.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A boat 10 embodying the invention is illustrated in the drawings. While the illustrated boat is a pontoon boat, it should be understood that the invention is applicable to other types of boats.

The boat 10 comprises a generally rectangular deck 14, and a pair of spaced-apart pontoons 18 supporting the deck 14 for floatation on a body of water. The boat 10 also comprises a helm 22 which is located on the deck 14 and which includes a steering wheel 26 operably connected to a suitable marine propulsion device (not shown), such as an outboard motor, mounted at the rearward end of the deck 14. The boat 10 also comprises an operator s seat 30 located adjacent and rearwardly of the helm 22. The boat 10 further comprises side walls 34 extending upwardly from the deck 14. The boat 10 as thus far described is conventional.

Figure 5:
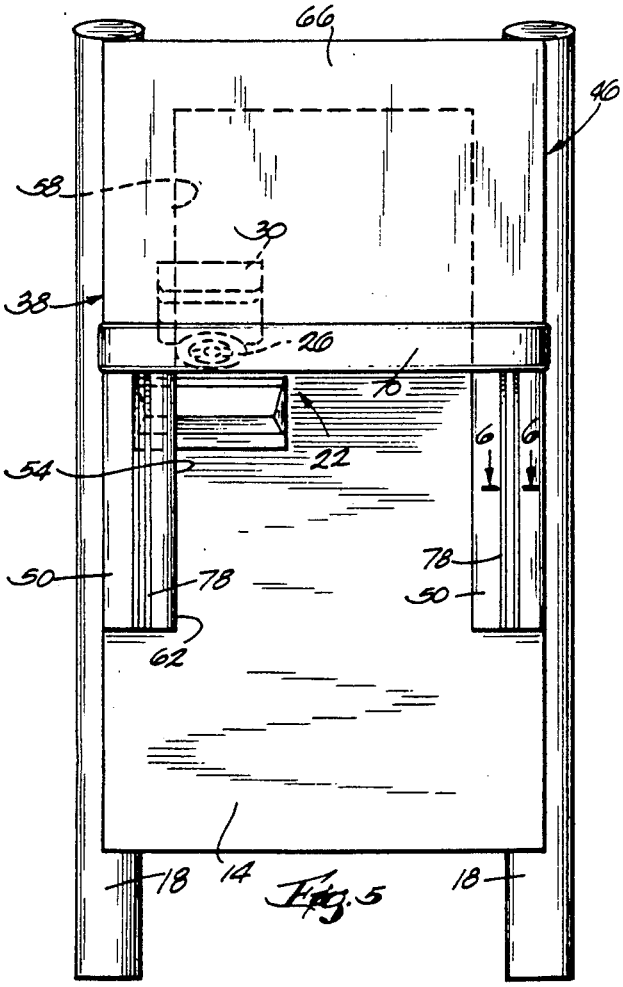
FIG. 5 is a plan view of the boat.

The boat 10 further comprises canopy means 38 operable in a first mode (shown in FIG. 1) wherein the canopy means 38 is spaced a first distance D1 above the deck 14 and a second mode (shown in FIG. 2) wherein the canopy means 38 is spaced a second distance D2 less than the first distance D1 above the deck 14, wherein the canopy means 38 is located above the helm 22, and wherein the canopy means 38 permits an operator 42 to be positioned at the helm 22. While various suitable canopy means can be used, in the illustrated construction, the canopy means 38 includes (see FIG. 5) a canopy 46 including a pair of laterally spaced-apart, generally parallel portions 50 defining therebetween an opening 54 having rearward and forward portions 58 and 62, respectively. The canopy 46 also includes a permanent cover 66 extending between the canopy portions 50 and over the rearward portion 58 of the opening 54. The canopy 46 further includes a removable cover 70 extending between the canopy portions 50. The removable cover 70 is movable between an extended position (FIG. 1) wherein the removable cover 70 extends over the forward portion 62 of the opening 54 such that the permanent cover 66 and the removable cover 70 extend over the entire opening 54, and a retracted position (FIGS. 2, 3 and 5) wherein the forward portion 62 of the opening 54 is uncovered. The cover 70 has therethrough a plurality of support rods 74 (partially shown in FIG. 6) extending between the canopy portions 50.

Figure 6:
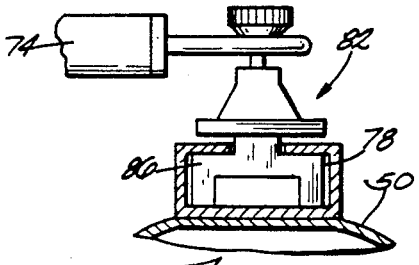
FIG. 6 is a view which is taken along line 6—6 in FIG. 5 and which shows a support rod.

The canopy 46 also includes means supporting the removable cover 70 on the canopy portions 50 for movement between the extended position and the retracted position. While various suitable supporting means can be employed, in the preferred embodiment, such means includes, on the upper surface of each of the canopy portions 50, a track 78 (FIGS. 5 and 6) extending in the fore and aft direction. As shown in the drawings, the track 78 is preferably an elongated, upwardly opening channel. The supporting means also includes, on each end of each of the support rods 74, a member 82 (FIG. 6) slideably received in the associated track 78. As shown in FIG. 6, each of the members 82 includes a portion 86 received in the associated track 78 so as to prevent upward movement of the removable cover 70 relative to the track 78. The members 82 are preferably fabricated of a low-friction material to facilitate sliding movement of the members 82 relative to the tracks 78.

The canopy 46 also includes means for releasably securing the removable cover 70 in the extended position. While various suitable means can be employed, in the preferred embodiment, such means includes a plurality of snap fasteners (not shown) securing the forward end of the cover 70 to the forward ends of the canopy portions 50.

Figure 2:
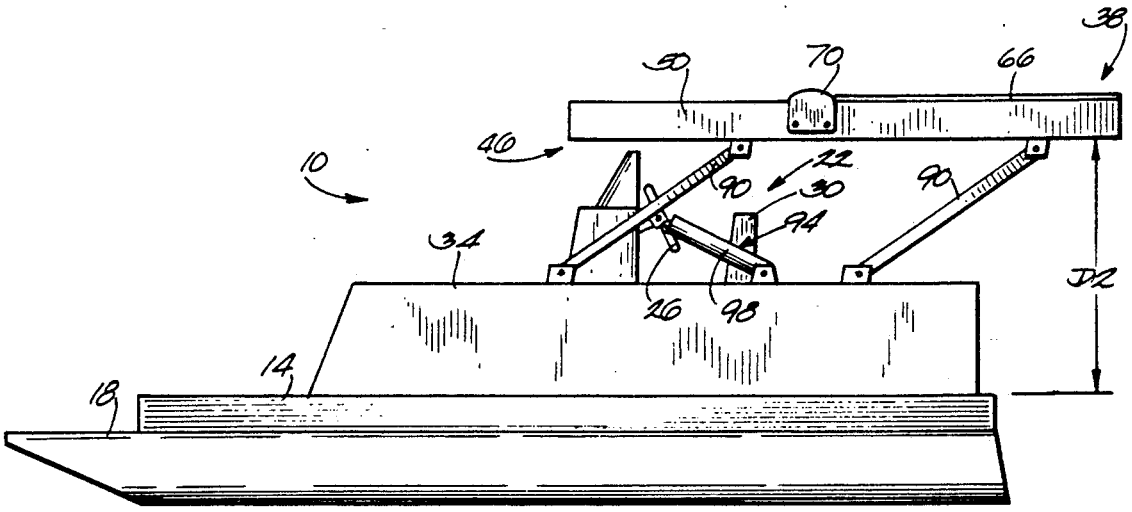
FIG. 2 is a side elevational view of the boat with the canopy in its lowered position.
Figure 3:
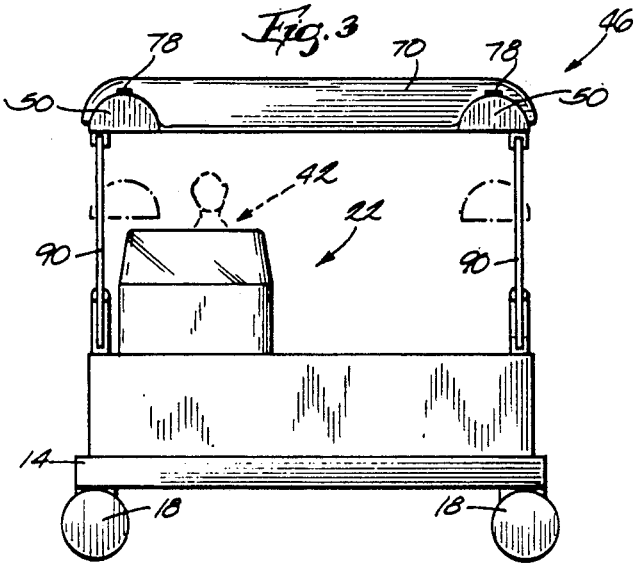
FIG. 3 is a front elevational view of the boat as shown in FIG. 2.

The canopy means 38 also includes means for moving the canopy 46 relative to the deck 14 between a raised position (FIG. 1) and a lowered Position (FIG. 2). In the raised position, the canopy 46 is spaced the first distance D1 above the deck 14 and is located above the helm 22 and the operator's seat 30. The first distance D1 is sufficient to permit the operator 42 to stand at the helm 22 or to sit in the operator's seat 30 when the removable cover 70 is in its extended position. In the lowered position, the canopy 46 is spaced the second distance D2 above the deck 14 and the forward portion 62 of the opening 54 is located above the helm 22 and the operator's seat 30. The second distance D2 is such that the canopy portions 50 are located at approximately the same level as the top of the operator's seat 30. Accordingly, when the canopy 46 is in its lowered position and the removable cover 70 is in its extended position, the removable cover 70 substantially prevents the operator 42 from being positioned at the helm 22 and operating the boat 10. However, when the canopy 46 is in its lowered position and the removable cover 70 is in its retracted position, as shown in FIG. 3 in dotted lines, the head of the operator 42 can extend through the forward portion 62 of the opening 54, so that the canopy means 38 permits the operator 42 to be positioned at the helm 22 and to operate the boat 10.

While various suitable means can be employed for moving the canopy 46 between its raised and lowered positions, in the illustrated construction, such means includes means for supporting the canopy 46 above the deck 14. Preferably, the supporting means includes, on each side of the boat 10, a pair of spaced-apart support members 90 (FIGS. 1 and 2) which extend generally vertically when the canopy 46 is in its raised position and each of which has a lower end pivotally connected to the associated side wall 34, and therefore to the deck 14, and an upper end pivotally connected to the associated canopy portion 50. The support members 90, the canopy portion 50 and the side wall 34 form a parallelogram. The means for moving the canopy 46 also includes means for moving the supporting means. In the preferred embodiment, such means includes means for pivotally moving the support members 90 relative to the side wall 34 or to the deck 14. While various suitable moving means can be employed, in the preferred embodiment, such means includes, on each side of the boat 10, a hydraulic cylinder-piston assembly 94 (FIGS. 1 and 2) having a lower end pivotally connected to the side wall 34, and therefore to the deck 14, and an upper end pivotally connected to one of the associated support members 90. As shown schematically in FIG. 4, each hydraulic assembly 94 includes a cylinder 98 pivotally connected to the associated side wall 34, and a piston 102 which is slideably housed in the cylinder 98 and which divides the cylinder into upper and lower fluid chambers 106 and 110, respectively (the assemblies 94 are shown upside down in FIG. 4, so that the chambers 106 and 110 are not in their actual positions as in FIGS. 1 and 2). The hydraulic assembly 94 also includes a piston rod 114 having a lower end fixedly connected to the piston 102 and an upper end pivotally connected to the associated support member 90.

Figure 4:
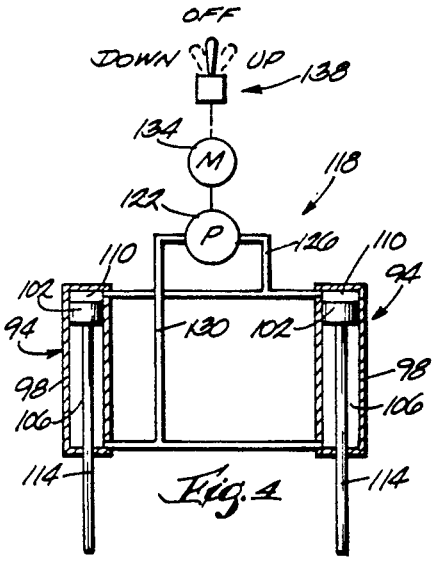
FIG. 4 is a schematic view of the hydraulic circuit for moving the canopy between its raised and lowered positions.

The moving means further includes (see FIG. 4) a hydraulic circuit 118 communicating with the hydraulic assemblies 94. As shown in FIG. 4, the hydraulic circuit 118 includes a reversible pump 122, a first conduit 126 communicating between the pump 122 and the lower chambers 110 of the hydraulic assemblies 94, and a second conduit 130 communicating between the pump 122 and the upper chambers 106 of the hydraulic assemblies 94. When the pump 122 is driven in a first direction, fluid is pumped to the lower chambers 110 via the first conduit 126 and fluid returns to the pump 122 via the second conduit 130. When the pump 122 is driven in an opposite second direction, fluid is pumped to the upper chambers 106 via the second conduit 130 and fluid returns to the pump 122 via the first conduit 126.

The moving means further includes (see FIG. 4) a reversible motor 134 drivingly connected to the pump 122. The motor 134 is preferably electrically actuated and is controlled by a suitable switch 138 located at the helm 22. The switch 138 is movable between an "off" position in which the motor 134 does not drive the pump 122, an "up" position in which the motor 134 drives the pump 122 in the above-described first direction, and a "down" position in which the motor 134 drives the pump 122 in the above-described second direction.

During normal operation of the boat 10, the canopy 46 is located in its raised position, and the removable cover 70 is located in its extended position. If it is desired to drive the boat 10 beneath a bridge or other overhead obstacle that is lower than the canopy 46 in its raised position, the canopy 46 is moved to its lowered position and the removable cover 70 is moved to its retracted position. This permits the operator 42 to remain at the helm 22 to drive the boat 10 beneath the bridge or other overhead obstacle.

Various features of the invention are set forth in the following claims.

We claim:

1. A boat comprising a deck having thereon a forwardly located helm, a canopy including a rearwardly located permanent cover, spaced-apart portions extending forwardly from said permanent cover and defining therebetween a forwardly open opening, and a second cover extending forwardly from said permanent cover and movable between a retracted position wherein said second cover does not extend over said opening and an extended position wherein said second cover extends over said opening, and means for moving said canopy relative to said deck between a raised horizontally extending position wherein said canopy is located above said helm and spaced a first distance above said deck so as to permit an operator to stand or sit adjacent said helm and under said second cover when said second cover is in said extended position and a lowered horizontally extending position wherein said canopy is spaced a second distance less than said first distance above said deck and wherein said opening is located above said helm so as to permit an operator to stand or sit adjacent said helm and between said spaced apart portions when said second cover is in said retracted position.

2. A boat as set forth in claim 1 wherein said opening is located above said helm when said canopy is in said lowered position, whereby the head of an operator can extend through said opening when said cover is in said retracted position.

3. A boat as set forth in claim 1 wherein said moving means includes hydraulic means.

4. A boat as set forth in claim 3 wherein said hydraulic means includes a cylinder-piston assembly.

5. A boat as set forth in claim 1 wherein said moving means for supporting said canopy above said deck, and means for moving said supporting means.

6. A boat as set forth in claim 5 wherein said supporting means includes generally parallel, spaced-apart support members which extend generally vertically when said canopy is in said raised position and each of which has a lower end pivotally connected to said deck and an upper end pivotally connected to said canopy, and wherein said moving means includes means for pivotally moving said support members relative to said deck.

7. A boat as set forth in claim 6 wherein said moving means includes a hydraulic cylinder-piston assembly having one end pivotally connected to said deck and an opposite end tally connected to one of said support members.

8. A boat as set forth in claim 1 wherein said deck also has thereon an operator's seat located adjacent said helm.

9. A boat comprising a deck having thereon a forwardly located helm and an operator's seat located adjacent said helm, a canopy including a rearward portion comprising a permanent cover, spaced-apart portions extending forwardly from said rearward portion and defining therebetween a forwardly open opening, and a second cover movable between a retracted position wherein said second cover is located adjacent said permanent cover and does not extend over said opening and an extended position wherein said second cover extends over said opening, and means for moving said canopy relative to said deck between a raised position wherein said canopy is spaced a first distance above said deck with said canopy above said helm, whereby to permit an operator, when said second cover is in said extended position, to sit in said seat with the operator's head beneath said canopy, and a lowered position wherein said canopy is spaced a second distance less than said first distance above said deck and wherein said opening is located above said helm, whereby to permit an operator, when said second cover is in said retracted position, to sit in said seat with the operator's head located in said opening, said opening means including generally parallel, spaced-apart support members which extend generally vertically when said canopy is in said raised position and each of which has a lower end pivotally connected to said deck and an upper end pivotally connected to said canopy, and said moving means also including means including a hydraulic cylinder-piston assembly having one end pivotally connected to said deck and an opposite end pivotally connected to one of said support members for pivotally moving said support members relative to said deck.

10. A boat comprising a deck having thereon a forwardly located helm, a canopy including a rearward portion comprising a permanent cover, spaced-apart portions extending forwardly from said rearward portion and defining therebetween a forwardly open opening located above said helm, and a second cover movable between a retracted position wherein said second cover is located adjacent said permanent cover and does not extend over said opening and an extended position wherein said second cover extends over said opening, and means for supporting said canopy above said deck.

11. A boat as set forth in claim 10 and further comprising means for moving said supporting means so as to move said canopy relative to said deck between a raised position wherein said canopy is spaced a first distance above said deck and a lowered position wherein said canopy is spaced a second distance less than said first distance above said deck.

12. A boat as set forth in claim 11 wherein said opening is located above said helm when said canopy is in said lowered position, whereby the head of an operator can extend through said opening when said cover is in said retracted position.

13. A boat as set forth in claim 11 wherein said moving means includes hydraulic means.

14. A boat as set forth in claim 13 wherein said hydraulic means includes a cylinder-piston assembly.

15. A boat as set forth in claim 10 wherein said supporting means includes generally parallel, spaced-apart support members which extend generally vertically when said canopy is in a raised position and each of which has a lower end pivotally connected to said deck and an upper end pivotally connected to said canopy.

16. A boat as set forth in claim 15 and further comprising means for pivotally moving said support members relative to said deck.

17. A boat as set forth in claim 16 wherein said moving means includes a hydraulic cylinder-Piston assembly having one end pivotally connected to said deck and an opposite end pivotally connected to one of said support members.

18. A boat as set forth in claim 10 wherein said deck also has thereon an operator's seat located adjacent said helm.

* * * * *